US005823765A

United States Patent [19]

La Forest

[11] Patent Number: 5,823,765

[45] Date of Patent: Oct. 20, 1998

[54] LIGHTER HAVING A NON-ROTATING FLINT

[75] Inventor: Guy La Forest, Cascais, Portugal

[73] Assignee: BIC Corporation, Milford, Conn.

[21] Appl. No.: 948,382

[22] Filed: Oct. 9, 1997

[51] Int. Cl.[6] ..... F23Q 1/02

[52] U.S. Cl. ..... 431/276

[58] Field of Search ..... 431/276, 277

[56] References Cited

U.S. PATENT DOCUMENTS 1,762,281 3/1930 Stecker ..... 431/276

4,509,916 4/1985 Laforest Le Budec ..... 431/273

5,483,978 1/1996 Doiron ..... 131/329

5,490,773 2/1996 Lloveras Capilla ..... 431/153

*Primary Examiner*—Carroll Dority

*Attorney, Agent, or Firm*—Pennie & Edmonds LLP

[57] ABSTRACT

An apparatus is disclosed for providing more uniform lighter spark wheel actuation. Uniform actuation is facilitated in the apparatus according to the invention by reducing the resistance encountered from the rotation of the flint on its axis due to the screw-thread-like action of the cutting member on the flint. In an exemplary embodiment of the invention, a non-rotatable pyrophoric flint is utilized which illustratively includes a body having a non-circular cross section.

13 Claims, 2 Drawing Sheets

LIGHTER HAVING A NON-ROTATING FLINT

BACKGROUND OF THE INVENTION

1. Technical Field

The present invention relates to a lighter which consumes hydrocarbon fuel such as butane and includes a spark producing means. Specifically, the present invention relates to an improved spark producing means for a lighter which is more uniformly operatable.

2. Discussion of the Related Art

A conventional cigarette lighter includes a body containing a fuel reservoir filled with a liquified and pressurized hydrocarbon fuel, a valve actuator lever, a spark wheel, a flint in frictional contact with the spark wheel, and a fuel flow control valve in fluid communication with the fuel reservoir. After the spark wheel is rotated against the flint by digital manipulation to produce sparks, the valve actuator lever is depressed allowing gaseous hydrocarbon fuel to flow out of the reservoir through the flow control valve. The sparks then ignite the released fuel to produce a flame. Such lighters are known in the art and are commercially available.

Specific means for producing ignition sparks when contacting a pyrophoric flint in these lighters are also known in the art. For example, U.S. Pat. No. 4,509,916 to Le Boudec discloses a device for producing an ignition spark when contacting a flint. The device includes a flint cutting member made from helically-coiled wire with a circular cross section which includes saw-teeth projections for contacting and cutting the flint to create sparks. The flint, has a circular cross section. This device may be configured and adapted for use as a spark producing means in known lighters.

However, such related art spark producing means are disadvantageous in that irregular friction is produced between the flint and the user-rotatable spark wheel. This irregular friction leads to non-uniform rotational force requirements for rotating the spark wheel, and thus may increase the difficulty in producing ignition sparks.

More particularly, when a flint with a circular cross section is utilized in conjunction with certain prior art spark wheels, the surface of the flint contacting the coil can become deeply grooved over time so as to match the spacing of the toothed surface of the cutting member. In addition, the rotation of the cutting member, with teeth arranged along a helical pattern, against the flint during use may urge the flint to rotate about its central axis.

These factors, i.e., the deep grooving of the flint surface (and resulting high ridges), the helical arrangement of teeth, and the urged rotation of the flint during use, are disadvantageous in combination as they bring about non-uniform user actuation of the spark wheel. More specifically, the flint, with a highly ridged/deeply grooved striking surface as shown in FIG. 4, provides significant non-uniform resistance to user rotation of the spark wheel assembly as the cutting member is required to periodically break through the high ridges due to the helical path of the teeth. The nonuniformity of the force required to rotate the spark wheel assembly is increased further when the flint itself rotates on its axis as a result of the screw-thread-like action of the cutting member on the flint. Such rotation of the flint is difficult for the user to overcome due to the high ridges on the flint surface which require a relatively high force to break through and binding which can occur between the teeth of the cutting member and the grooved surface as a result of rotation at the flint.

Highly non-uniform resistance is especially disadvantageous in many of the newer child resistant lighters. For example, U.S. Pat. No. 5,483,978 to Doiron discloses a child resistant lighter with a guard which partially covers the spark wheel, thereby increasing the difficulty of rotating the same. This spark wheel cover, when combined with the non-uniform force requirements of the related art spark producing means, can result in non-uniform and unpredictable increases in the difficulty of lighter actuation by intended users.

SUMMARY OF THE INVENTION

In view of the above disadvantages of the related art, it is an object of the present invention to provide a spark producing means which facilitates smooth, uniform actuation by intended users.

It is a further object of the invention to provide such a spark producing means that is relatively easy to manufacture and that requires minimal design modification.

In accordance with the present invention, a flame producing lighter is provided that includes a lighter body containing a fuel reservoir with a valve for releasing fuel. The lighter further includes a valve actuator depressible by a user to actuate said valve and release said fuel, and a spark producing element rotatable by a user to produce sparks directed towards the released fuel. In addition, the lighter includes a flint contained within the lighter body and in frictional contact with the spark producing element wherein rotation of the spark producing element against the flint creates sparks directed towards released fuel.

In the lighter according to the present invention, uniform spark wheel actuation is facilitated by preventing rotation of the flint around its central access during use, thus decreasing the peak force required for rotation of the spark wheel. In an exemplary embodiment of the invention, a non-rotatable pyrophoric flint is utilized that includes a body having a non-circular cross section and a predetermined length. Use of a non-circular flint ensures that, during actuation, the flint does not rotate on its axis as a result of the screw-thread-like action of the cutting member on the flint. This result is advantageous as rotation of the flint during use may be difficult for the user to overcome due to the high ridges on the flint surface which require a relatively high force to break through.

BRIEF DESCRIPTION OF THE DRAWINGS

These and other methods, structures, features, aspects, and advantages of the present invention will become more readily apparent from the following detailed description, which should be read in conjunction with the accompanying drawings, in which:

FIGS. 1A–1B illustrate a flame producing lighter containing a flint according to the invention, wherein FIG. 1A is a cross-sectional view of the top portion of a flame producing lighter, and FIG. 1B is a side view of a flame producing lighter;

DETAILED DESCRIPTION OF THE INVENTION

Figure 1A:
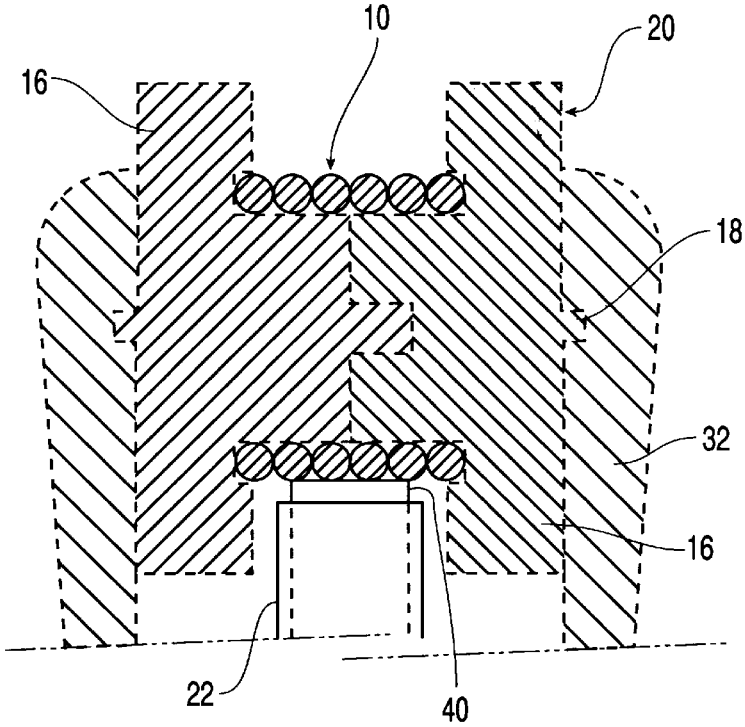

The following embodiments of the present invention will be described in the context of a lighter including a spark producing means as described herein, although those skilled in the art will recognize that the disclosed methods and structures are readily adaptable for broader application. Note that whenever the same reference numeral is repeated with respect to different figures, it refers to the corresponding structure in each such figure.

Figure 4:
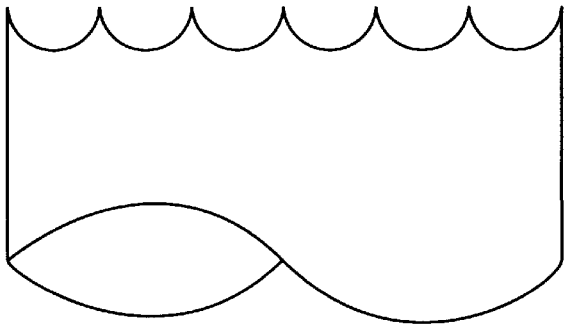
FIG. 4 PRIOR ART
FIG. 4 is an outline of the profile of a prior art flint as acted on by a spark wheel, which illustrates the grooves and high ridges resulting from the spark wheel.

As previously mentioned, when a flint is utilized in conjunction with a spark wheel cutting member fashioned from wire with a circular cross section, the surface of the flint contacting the cutting member develops deep grooves separated by relatively high ridges which generally match the cutting member surface as illustrated in FIG. 4. Moreover, the rotation of the spirally formed cutting member contacting the flint during use acts like a screw thread on the high ridges, urging the flint to rotate about its central axis. Eventually, the spiral cutting surface results in particular spots in the rotation of the spark wheel having increased resistance to rotation. This localized increase in resistance is irregular and creates a peak force for rotation that is difficult or impossible for some intended users to overcome.

Thus, in accordance with the invention, more uniform spark wheel actuation is facilitated by reducing the peak force necessary for rotation of the spark wheel assembly. In an exemplary embodiment of the invention, a non-rotatable flint is utilized, thereby decreasing the resistance encountered from the rotation of the flint on its axis due to the screw-thread-like action of the cutting member on the flint. As previously mentioned, rotation of the flint is difficult for the user to overcome due to the high ridges on the flint surface that require a relatively high force to break through.

Figure 2:
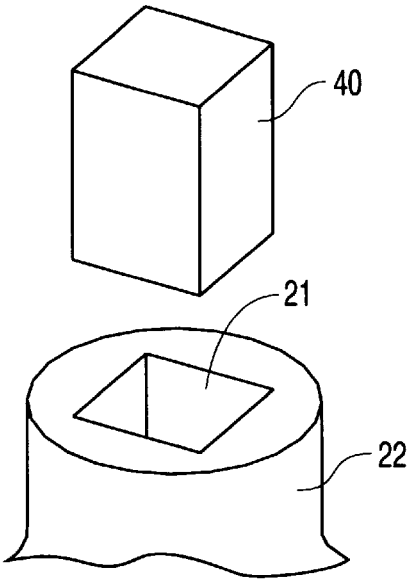
FIG. 2 is a partial, exploded perspective view of one embodiment of the invention.

In accordance with the foregoing, FIG. 1A discloses a spark wheel assembly 20 employing a helical spark wheel coil 10. As shown in FIG. 1A, coil 10 may be disposed between turning wheels 16. Coil 10 and turning wheels 16 are connected to one another and mounted coaxially on axle 18 so as to form the spark wheel assembly. As also shown in FIG. 2, pyrophoric flint 40 is disposed in a central cavity 21 in projection 22 positioned within lighter body 32 to cooperate with the spark wheel assembly, and may be urged into frictional contact with coil 10 by a spring (not shown).

Figure 1B:
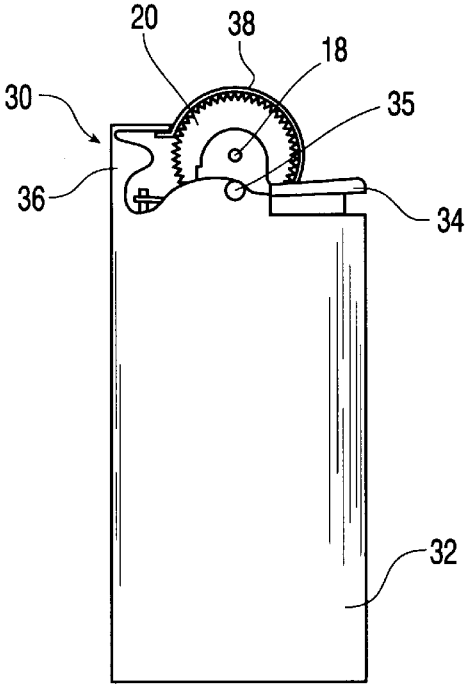

Spark wheel assembly 20 may be used in conjunction with other mechanisms so as to form a lighter. More particularly, and as shown in FIG. 1B, spark wheel assembly 20 may be mounted on the body 32 of a lighter 30 defining central cavity 21. Lighter 30 further comprises a valve actuator 34 which is pivotally mounted on body 32 through tabs 35, located below axle 18. Valve actuator 34 controls the release of fluid from a fuel reservoir within lighter body 32.

Lighter 30 further includes a windshield 36, and a protective guard 38, which as previously discussed, is disposed above a portion of spark wheel assembly 20 so as to deter operation by unintended users. Such a lighter is described, for example, in detail in U.S. Pat. No. 5,520,197 to McDonough et al., which is incorporated herein by reference, and its general construction and operation are well understood by persons of skill in the art. Similarly, the present invention is equally advantageous when utilized in conjunction with other child-resistancy means wherein the focus is on increased difficulty of spark creation by unintended users. Examples of lighters employing such means are U.S. Pat. No. 5,490,773 to Lloveras Capilla and U.S. Pat. No. 5,096,414 to Zellweger, both of which are incorporated by reference herein.

As mentioned above, uniform spark wheel actuation may be facilitated by ensuring that flint 40 cannot rotate about its axis during use. One means for ensuring a lack of rotation in flint 41 is to utilize a key and slot arrangement in which flint 41, as shown in FIG. 3A, includes key 42, and the central cavity of projection 22 includes a slot (configured to receive the key) running the length of the same.

A second exemplary means for ensuring a lack of rotation is to configure the flint with a regular, but non-circular cross section, and to configure the cavity which retains the flint to correspond to the shape of the non-circular flint. FIGS. 3B and 3C disclose alternative embodiments of a pyrophoric flint according to the present invention. As shown in FIGS. 3B and 3C, the flint may illustratively include a square cross section (flint 40) or a hexagonal cross section (flint 44), with the central axis at A. If a square cross section is used, the lighter flint cavity is ideally configured in a square cross-sectional fashion as well. Likewise, if the hexagonal cross section is used, the lighter flint cavity is ideally configured in a hexagonal fashion.

Figure 3A:
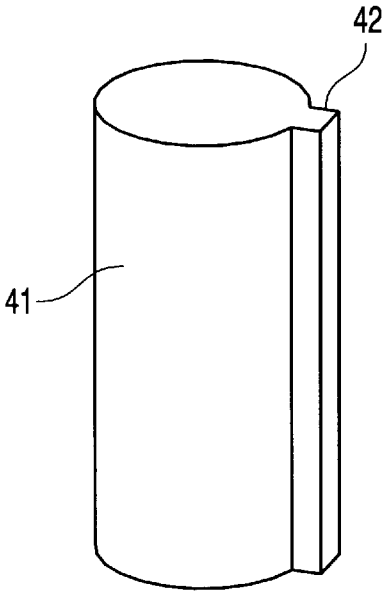
FIGS. 3A–3C are perspective views of exemplary pyrophoric flints according to the invention.
Figure 3B:
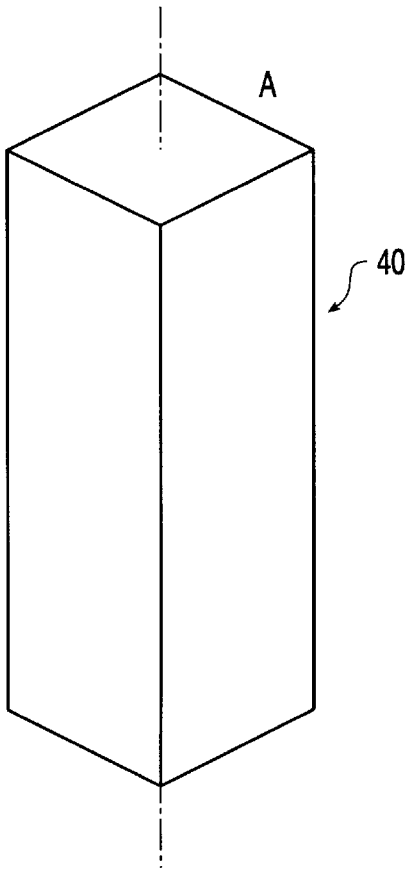
Figure 3C:
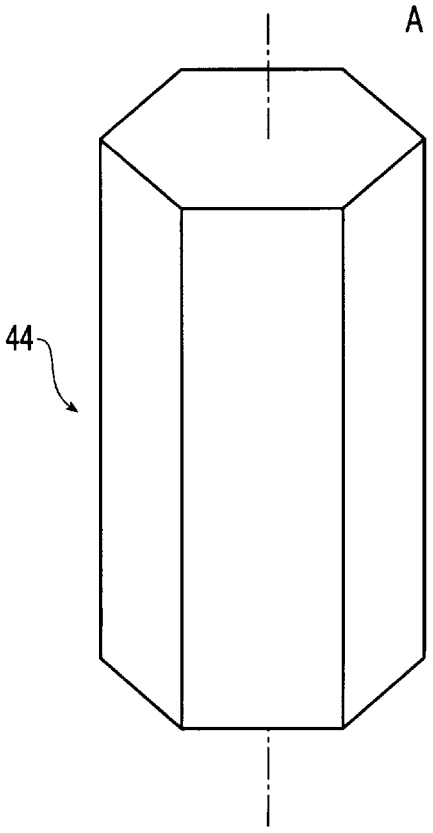

Although only keyed, square and hexagonal cross sections are disclosed in FIGS. 3A–3C, it is contemplated that any flint configured with a non-circular cross section which prevented rotation would still fall within the scope of the invention. Likewise, although the cavity in projection 22 housing the flint is ideally configured so as to match the flint, the cavity could be configured in any manner which ensures a lack of rotation of the flint itself (e.g., a square flint paired with an octagonal flint cavity). Alternatively, it is not necessary that the non-circular cross-section be carried over the full length of the flint. It is sufficient if the non-circular portion extends only enough to provide sufficient strength to resist rotation.

By preventing rotation of the flint, the helically arranged teeth of the cutting member tend to scour the striking surface of the flint, which may reduce the high ridges. However, even if the cutting member is such that deep grooves or high ridges are formed, by preventing rotation of the flint, the grooves or ridges will not bind with the teeth.

Various embodiments of the invention have been described. The descriptions are intended to be illustrative, not limitative. Thus, it will be apparent to those skilled in the art that modifications may be made to the invention as described without departing from the scope of the claims set out below.

I claim:

1. A flame producing lighter, comprising:

a lighter body containing a fuel reservoir with a valve for releasing fuel therefrom;

a valve actuator depressible by a user to actuate said valve and release said fuel;

a spark producing element rotatable by a user to produce sparks directed towards released fuel, said element mounted on said lighter body with at least a portion thereof exposed for manipulation and rotation by the user;

a flint contained within the lighter body and in frictional contact with the spark producing element wherein rotation of the spark producing element against the flint creates sparks directed towards released fuel; and a means for preventing rotation of the flint about its central axis during manipulation and rotation of the spark producing element.

2. The lighter according to claim 1, wherein said lighter body defines a cavity for housing said flint, and wherein said rotation preventing means comprises said flint and said chamber being configured and dimensioned so as to prevent rotation of the flint about its central axis during manipulation and rotation of the spark producing element.

3. The lighter according to claim 2, wherein said flint contained within the lighter body and in frictional contact with the spark producing element includes a non-circular cross section.

4. The lighter according to claim 3, wherein said flint has a square cross section.

5. The lighter according to claim 3, wherein said flint has a hexagonal cross-section.

6. The lighter according to claim 2, wherein said flint contained within the lighter body and in frictional contact with the spark producing element includes a key and said cavity includes a slot running the length of said cavity, said key slidably engaging said slot so as to prevent rotation of the flint about its central axis during manipulation and rotation of the spark producing element.

7. A flame producing lighter, comprising:

a lighter body containing a fuel reservoir with a valve for releasing fuel therefrom;

a valve actuator depressible by a user to actuate said valve and release said fuel;

a spark producing element rotatable by a user to produce sparks directed towards released fuel, said element mounted on said lighter body with at least a portion thereof exposed for manipulation and rotation by the user;

a flint contained within the lighter body and in frictional contact with the spark producing element wherein rotation of the spark producing element against the flint creates sparks directed towards released fuel; and a means for increasing the difficulty of spark generation by unintended users;

said flint configured and dimensioned and in combination with means to prevent rotation of said flint within the lighter body such that uniformity of spark generation by an intended user is increased.

8. The flame producing lighter according to claim 7, wherein said flint contained within the lighter body and in frictional contact with the spark producing element includes a non-circular cross section.

9. The flame producing lighter according to claim 7, wherein said lighter body defines a chamber for housing said flint, and wherein said flint contained within the lighter body and in frictional contact with the spark producing element includes a key and said chamber includes a slot running the length of said chamber, said key slidably engaging said slot so as to prevent rotation of the flint about its central axis during manipulation and rotation of the spark producing element.

10. A non-rotatable pyrophoric flint for use in a flame producing lighter, comprising a body having a non-circular cross section and a predetermined length.

11. The non-rotatable pyrophoric flint according to claim 10, wherein said body has a square cross section.

12. The non-rotatable pyrophoric flint according to claim 10, wherein said body has a hexagonal cross section.

13. The non-rotatable pyrophoric flint according to claim 10, wherein said body has a radially extending key.

* * * * *